US011801952B2

(12) United States Patent
Casadei

(10) Patent No.: US 11,801,952 B2
(45) Date of Patent: Oct. 31, 2023

(54) PLATFORM FOR PALLET WRAPPING MACHINES

(71) Applicant: C&C GROUP S.r.l., Cesena (IT)

(72) Inventor: Claudio Casadei, Cesena (IT)

(73) Assignee: C & C GROUP S.R.L., Cesena (IT)

( * ) Notice: Subject to any disclaimer, the term of this patent is extended or adjusted under 35 U.S.C. 154(b) by 0 days.

(21) Appl. No.: 17/730,706

(22) Filed: Apr. 27, 2022

(65) Prior Publication Data

US 2022/0348365 A1 Nov. 3, 2022

(30) Foreign Application Priority Data

Apr. 30, 2021 (IT) ..... 102021000011003

(51) Int. Cl.
*B65B 65/02* (2006.01)
*B65B 11/04* (2006.01)

(52) U.S. Cl.
CPC ..... *B65B 11/045* (2013.01); *B65B 65/02* (2013.01)

(58) Field of Classification Search
USPC ..... 53/587
See application file for complete search history.

(56) References Cited

U.S. PATENT DOCUMENTS 10,287,112 B2 5/2019 Saylor
2006/0000192 A1 1/2006 Lindstrom
2012/0175170 A1* 7/2012 Martin ..... G01G 19/52 177/201
2014/0353896 A1* 12/2014 Casadei ..... B65B 65/02 269/61
2015/0151861 A1* 6/2015 Chalmers ..... B65B 11/045 53/389.2
2017/0088301 A1* 3/2017 Riemenschneider, III ..... B65B 59/003

FOREIGN PATENT DOCUMENTS

WO 2010044077 A1 4/2010

OTHER PUBLICATIONS

Italian Search Report dated Jan. 14, 2022 from counterpart Italian App No. IT 202100011003.
European Search Report dated Aug. 18, 2022 from counterpart European App No. EP 22 02 0187.

* cited by examiner

*Primary Examiner* — Chinyere J Rushing-Tucker
(74) *Attorney, Agent, or Firm* — SHUTTLEWORTH & INGERSOLL, PLC; Timothy J. Klima

(57) ABSTRACT

A platform for pallet wrapping machines includes a fixed base resting on the ground and a turntable which rotates relative to the base and in which a plurality of rollers is integrated, the rollers projecting from it in such a way as to support a pallet and provided with a movement device integrated with them, in such a way that the platform has a total thickness not greater than 10 centimeters.

12 Claims, 6 Drawing Sheets

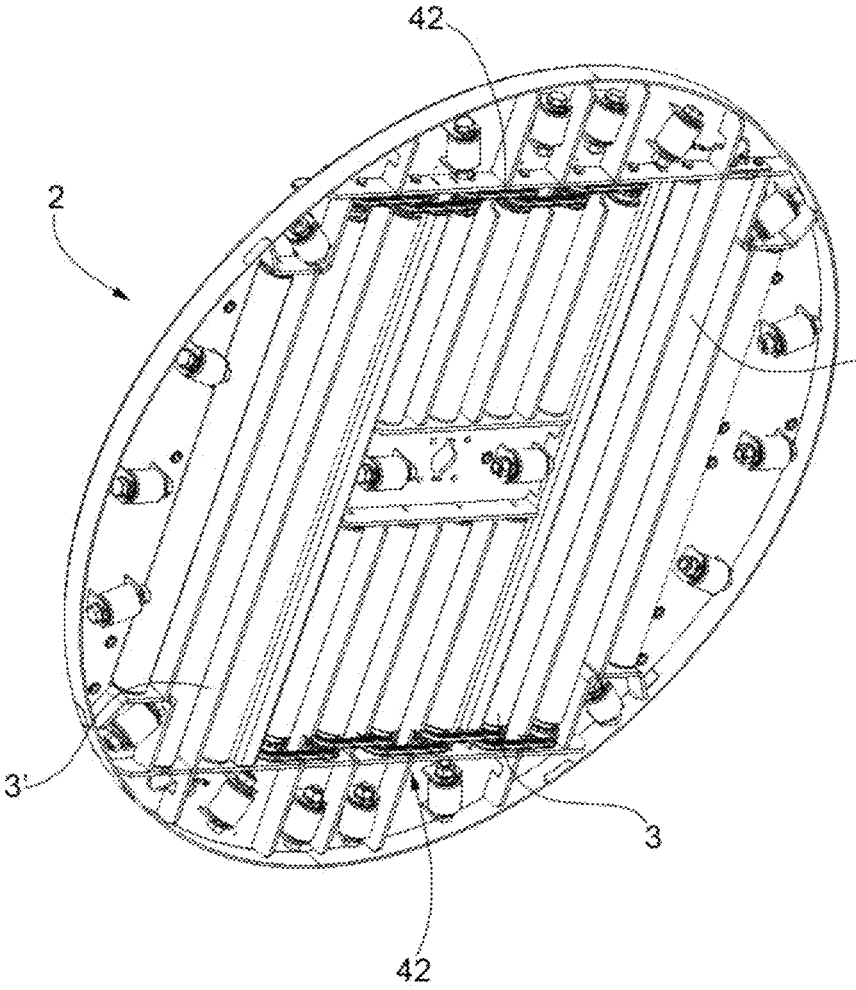
fig.4a
fig.4b
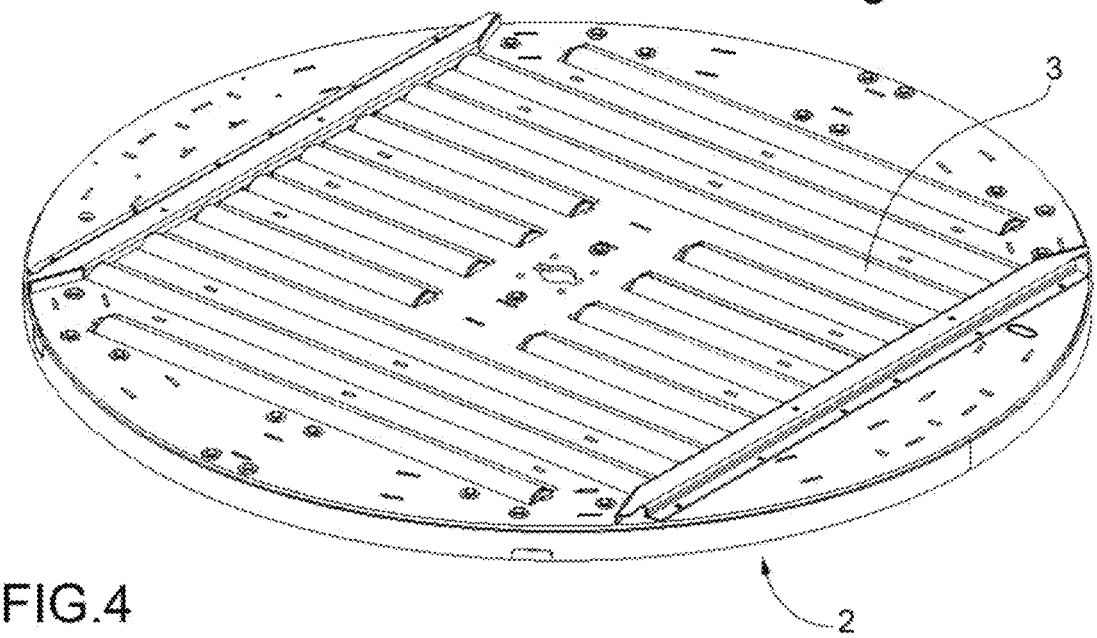
FIG.4

PLATFORM FOR PALLET WRAPPING MACHINES

This application claims priority to Italian Patent Application 102021000011003 filed Apr. 30, 2021, the entirety of which is incorporated by reference herein.

BACKGROUND OF THE INVENTION

This invention relates to a platform for pallet wrapping machines.

In recent decades there has been a huge spread in the practice of packaging "pallets", understood to be a set of packaging units, for example cases, stacked on a rigid support, using a stretch plastic film. The machines which carry out this operation, often called pallet wrapping machines, are usually inserted in pallet handling lines, of which they often form the final station. In these lines, the pallet moves forward on roller conveyors, therefore the pallet wrapping machine must also be provided with rotating rollers which allow pallet transit.

Considering the dimensions of pallets, having particularly extensive height, it is appropriate for the path on the rollers to be as regular as possible, in such a way as to avoid jolts which could compromise the stability of the load: the height at which the rollers are located is therefore determined by the wrapping station, in which superposing of the roller conveyor on the turntable results in total operating heights which are not less than around 30 centimeters.

This means that the pallets must be loaded on the line by fork-lift trucks, which can lift the loads to arbitrary heights, and not by pallet trucks, which would be much easier and simpler to use, but which cannot lift the pallet more than around 10 centimeters.

SUMMARY OF THE INVENTION

The aim of this invention is therefore to eliminate the above-mentioned disadvantages.

The invention, characterized as set out in the claims, achieves that aim by integrating a plurality of rollers with the turntable.

The main advantage obtained by means of this invention is basically the fact that there is a reduction to around 10 centimeters of the height of the wrapping station operating zone, and therefore of the entire handling line, in this way allowing the pallet to be loaded even using a pallet truck.

BRIEF DESCRIPTION OF THE DRAWINGS

Further advantages and features of the invention will be more apparent in the detailed description which follows, with reference to the accompanying drawings, which show an example, non-limiting embodiment, in which:

FIG. 4 shows a perspective bottom view (4*a*) and top view (4*b*) of another detail of the invention;

DESCRIPTION OF THE PREFERRED EMBODIMENTS

Figure 1:
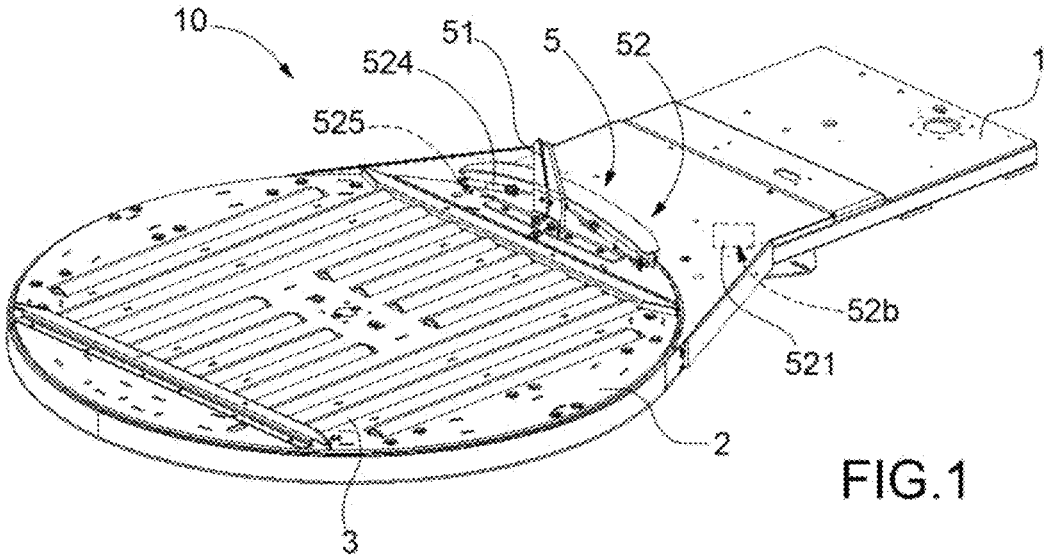
FIG. 1 is a perspective assembly view of the invention.
Figure 2:
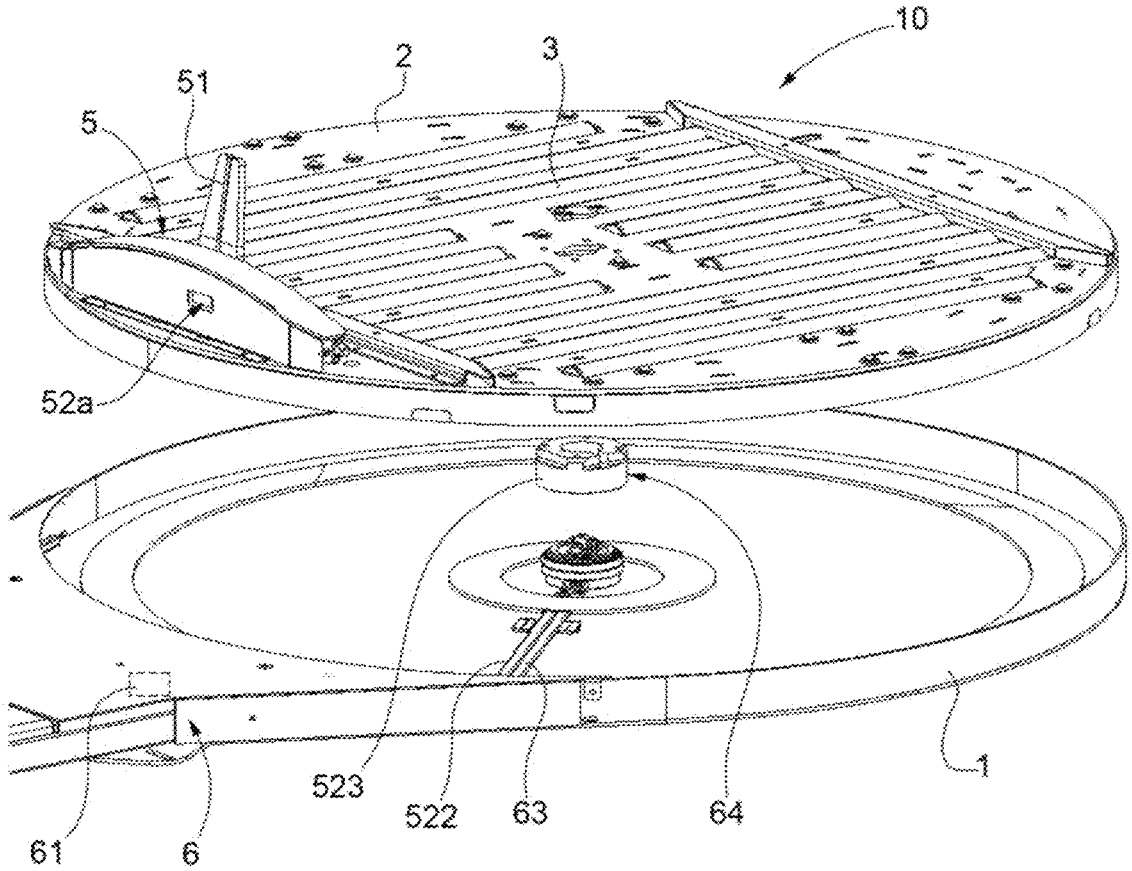
FIG. 2 is an exploded view of the invention.
Figure 3:
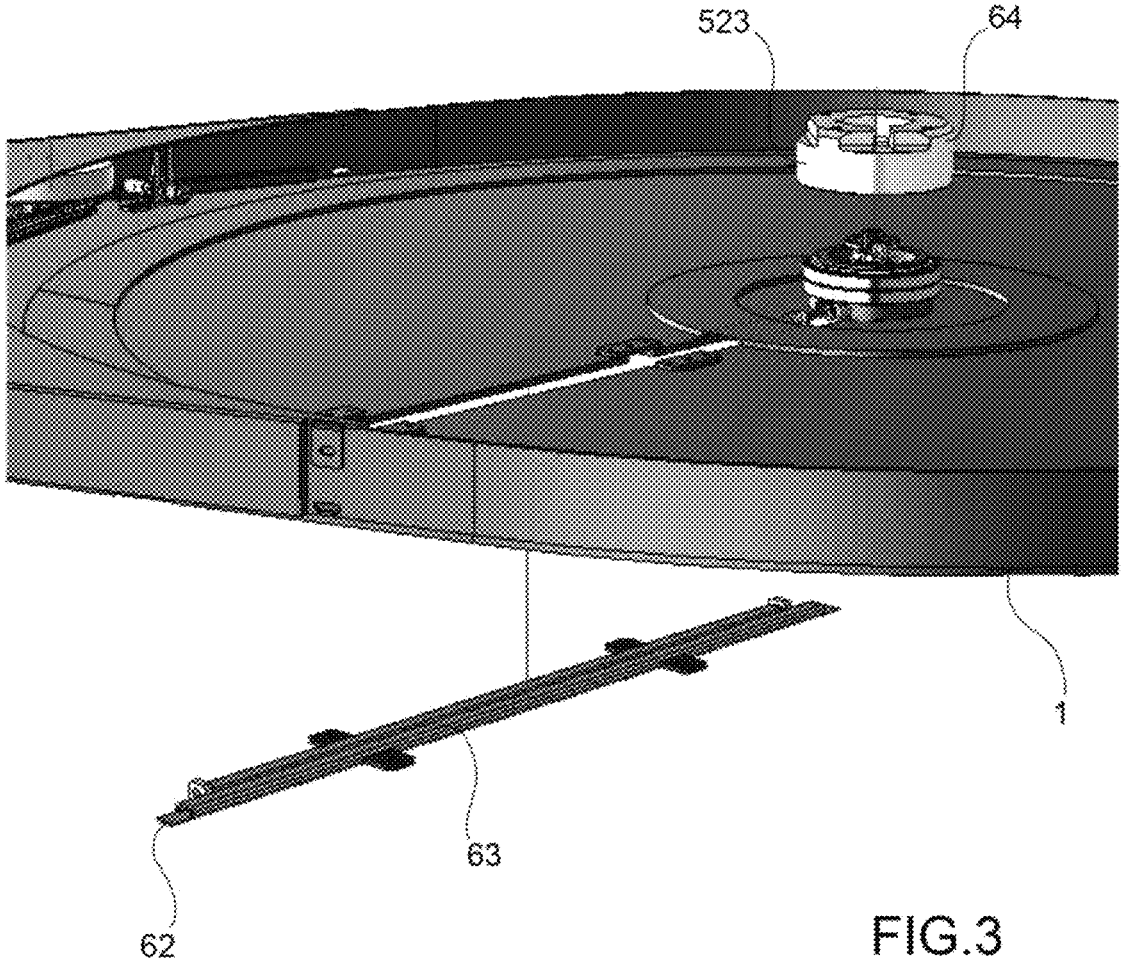
FIG. 3 is an exploded detail of the invention.
Figure 5:
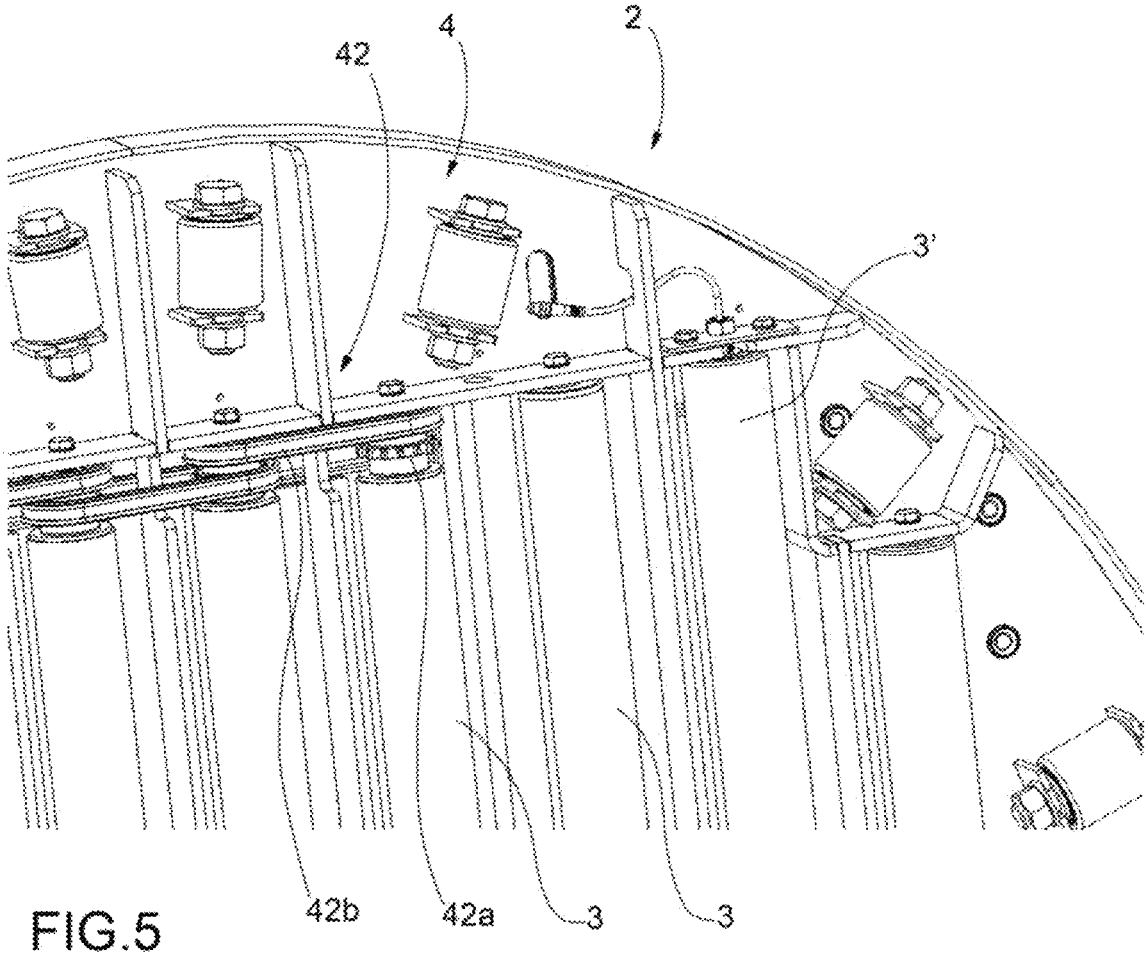
FIG. 5 is an enlarged view of the detail of FIG. 4*a;*

As can be seen from the figures, the invention relates to a platform for pallet wrapping machines, comprising a fixed base 1 resting on the ground and a turntable 2 which rotates relative to the base 1, a plurality of rollers 3 being integrated in the turntable. The rollers 3 integrated with the turntable 2 project from it in such a way as to be able to support a pallet, not shown here, and are provided with a movement device 4 which is integrated with them in such a way as to avoid the use of traditional roller conveyors and to reduce the total thickness of the platform 10 to around 10 centimeters.

Figure 10:
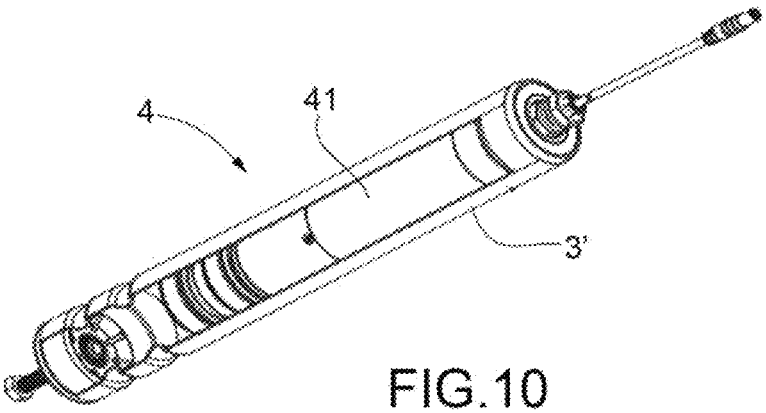
FIG. 10 is a perspective view of a further detail of the invention, with some parts cut away to better illustrate others.
Figure 6:
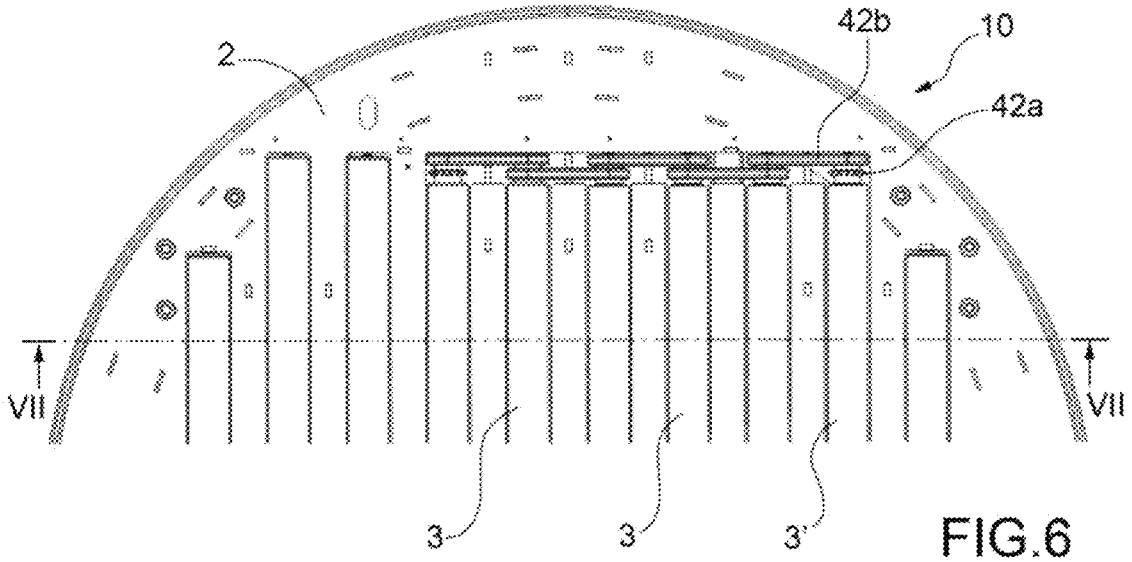
FIG. 6 is a partial top plan view of the invention, with some parts cut away to better illustrate others.
Figure 7:
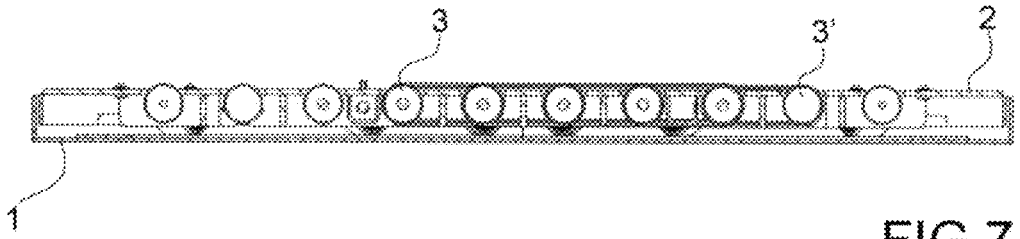
FIG. 7 shows the invention according to the cross-section VII-VII of FIG. 6.
Figure 8:
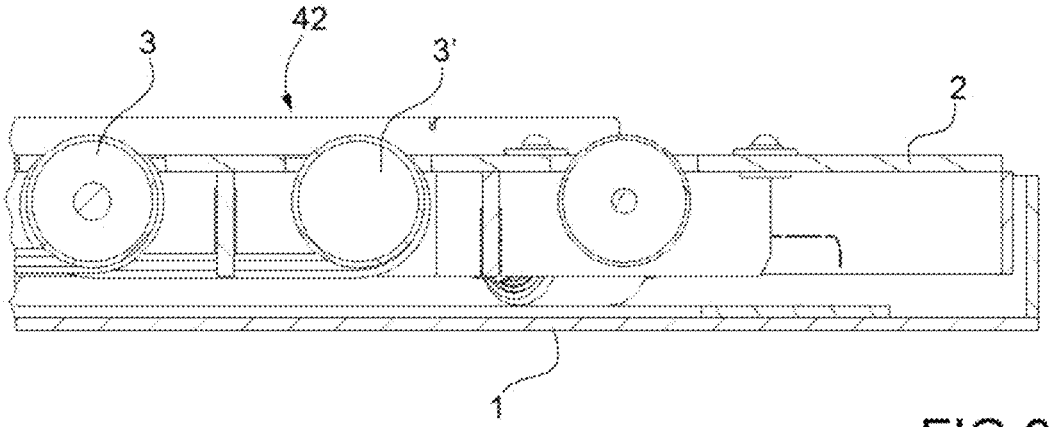
FIG. 8 is an enlarged detail from FIG. 7.
Figure 9:
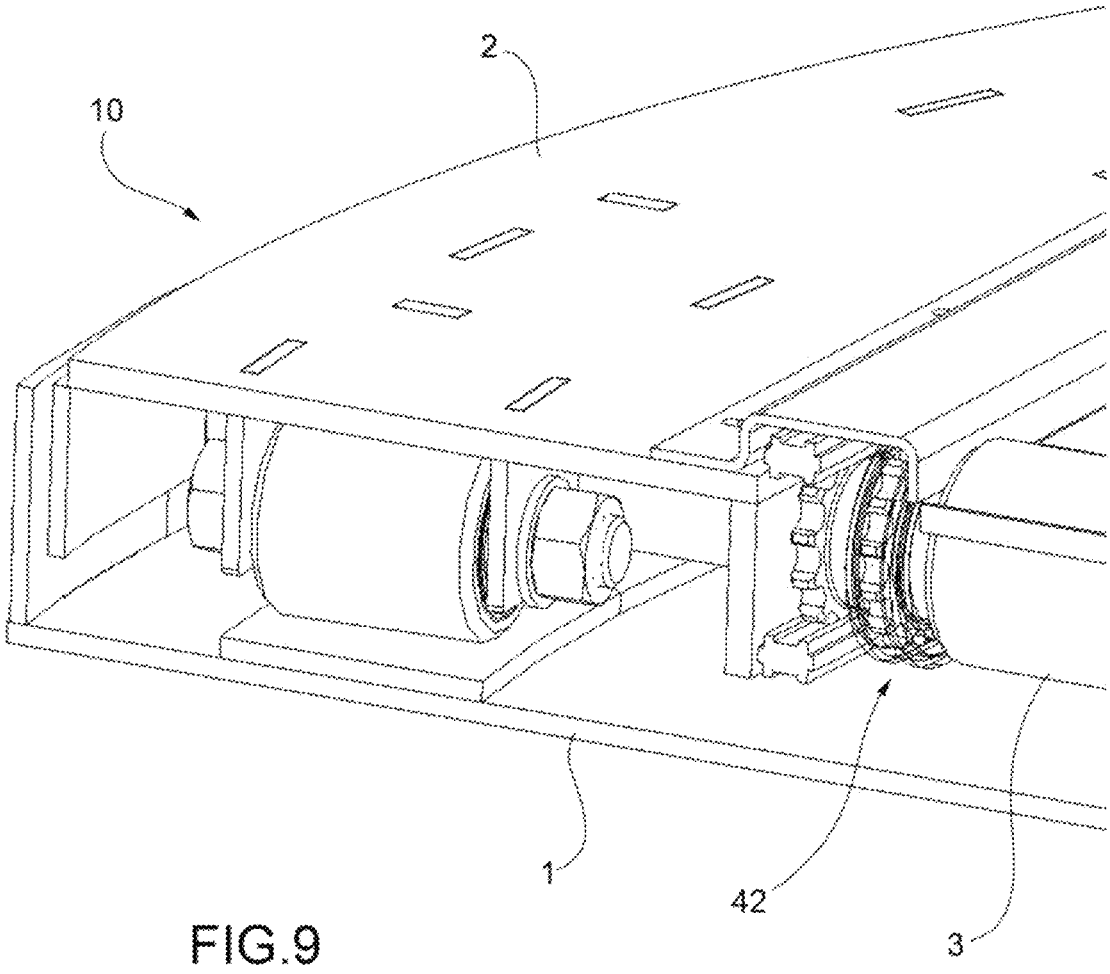
FIG. 9 is a perspective enlarged view of a longitudinal section of the invention.

The movement device 4 comprises at least one motor 41 inside a roller 3', an example of which is shown in FIG. 10, and motion transmission means 42, which are suitable for connecting the rollers 3 to each other. In the example embodiment shown in the figures, the motion transmission means 42 comprise gear wheels 42*a* fixed to the rollers 3 and a plurality of belts 42*b*, shaped to match the gear wheels 42*a*, which are suitable for connecting pairs of gear wheels 42*a* of adjacent rollers 3. In this solution, the movement device 4 comprises two motors 41 inside two rollers 3', in such a way as to make two sets of autonomously moved rollers 3.

The movement device 4 for the rollers 3 receives power from a power device 6 comprising an electricity dispenser 61, conducting cables 62 housed in a duct 63 fixed to the base 1 and leading to a slip ring 64 connected to the motors 41 inside the rollers 3'.

The platform 10 is also provided with a retaining device 5 for a flap of a plastic film for wrapping the pallet. It comprises a gripper 51 for clamping the film and control means 52 for the gripper 51, formed by an electronic control unit 52*a* which controls a compressed air device 52*b*.

The compressed air device 52*b* comprises a dispenser 521 of compressed air, a duct 522 fixed to the fixed base 1 leading to a rotary joint 523 fixed to the turntable 2, and a pair of pistons 524 connected to the rotary joint 523 by means of cables 525, which are suitable for making the gripper 51 pass from a closed position, in which it clamps the film at the start of wrapping, to an open position, and vice versa.

What is claimed is:

1. A platform for pallet wrapping machines, comprising:

a fixed base resting on a ground; and a turntable which rotates relative to the fixed base;

a plurality of rollers integrated with the turntable and projecting from the turntable to support a pallet; and a movement device for the rollers which is integrated with the rollers such that the platform has a total thickness not greater than 10 centimeters.

2. The platform according to claim 1, wherein the movement device comprises:

at least one motor positioned at least partly in one of the rollers; and a motion transmission device configured for connecting certain ones of the rollers to each other.

3. The platform according to claim 2, wherein the motion transmission device comprises gear wheels fixed to the certain ones of the rollers and at least one belt shaped to match the gear wheels.

4. The platform according to claim 3, wherein the at least one belt comprises a plurality of belts, suitable for connecting pairs of gear wheels of adjacent ones of the certain ones of the rollers.

5. The platform according to claim 4, wherein the at least one motor includes two motors and the movement device comprises the two motors at least partly positioned inside two of the certain ones of the rollers, to form two sets of autonomously moved rollers.

6. The platform according to claim 5, and further comprising a power device for the movement device.

7. The platform according to claim 6, wherein the power device comprises an electricity dispenser, conducting cables housed in a duct fixed to the fixed base and leading to a slip ring connected to the two motors at least partly positioned inside the two of the certain ones of the rollers.

8. The platform according to claim 2, wherein the at least one motor includes two motors and the movement device comprises the two motors at least partly positioned inside two of the certain ones of the rollers, to form two sets of autonomously moved rollers.

9. The platform according to claim 1, and further comprising a retaining device for a flap of a plastic film configured for wrapping the pallet.

10. The platform according to claim 9, wherein the retaining device comprises a gripper for clamping the plastic film, and a control device configured for controlling for the gripper.

11. The platform according to claim 10, wherein the control device comprises an electronic control unit which controls a compressed air device.

12. The platform according to claim 11, wherein the compressed air device comprises a dispenser of compressed air, a duct fixed to the fixed base leading to a rotary joint fixed to the turntable, and a pair of pistons connected to the rotary joint by cables, which are suitable for making the gripper pass from a closed position, in which the gripper clamps the film at a start of wrapping, to an open position, and vice versa.

* * * * *